US007636664B2

(12) United States Patent
Lee

(10) Patent No.: US 7,636,664 B2
(45) Date of Patent: Dec. 22, 2009

(54) GOLF COMMENTATOR

(76) Inventor: Steven J. Lee, 67 New Point Pl., Amityville, NY (US) 11701

( * ) Notice: Subject to any disclaimer, the term of this patent is extended or adjusted under 35 U.S.C. 154(b) by 608 days.

(21) Appl. No.: 10/870,287

(22) Filed: Jun. 17, 2004

(65) Prior Publication Data

US 2005/0283366 A1 Dec. 22, 2005

(51) Int. Cl.
*G10L 21/00* (2006.01)
*A63B 57/00* (2006.01)

(52) U.S. Cl. ..... 704/272; 473/224; 473/131

(58) Field of Classification Search ..... None
See application file for complete search history.

(56) References Cited

U.S. PATENT DOCUMENTS 4,191,378 A * 3/1980 Morin et al. ..... 473/224
4,840,371 A * 6/1989 Harris ..... 472/56
5,868,633 A * 2/1999 Keheley ..... 473/220
6,113,457 A * 9/2000 Kociemba ..... 446/297
6,461,248 B1 * 10/2002 Gross ..... 473/220
6,935,965 B1 * 8/2005 DeVarney ..... 473/224
2003/0216228 A1 * 11/2003 Rast ..... 482/84
2005/0020369 A1 * 1/2005 Davis et al. ..... 473/131
2005/0148402 A1 * 7/2005 Welles ..... 473/219
2005/0202892 A1 * 9/2005 Otten et al. ..... 473/151

FOREIGN PATENT DOCUMENTS

WO WO 9965574 A2 * 12/1999

OTHER PUBLICATIONS

"Philips 80C51-Baed Lowe Power, Low System Cost Microcontroller", Philips Electronics N.V. 1999.*

* cited by examiner

*Primary Examiner*—Matthew J Sked
(74) *Attorney, Agent, or Firm*—James J. Lillie; Lillie Law, LLC

(57) ABSTRACT

A putting device comprising a storage means having a plurality of recorded audio samples stored thereon; a randomizing means, and a sensing means; wherein all said means are cooperatively connected together; upon activation of said sensing means, said randomizing means selects an audio sample from said storage means for said putting device to audibilize.

10 Claims, 7 Drawing Sheets

GOLF COMMENTATOR

BACKGROUND OF THE INVENTION

This invention relates to an apparatus, which is used to increase the enjoyment of golf, in particular, a golfing device that comments on a player's shot making ability.

SUMMARY OF THE INVENTION

The present invention is directed to a golfing device having the primary objective of positive reinforcement while entertaining the golfer. In order to accomplish the foregoing objective, it is preferred that the golfing device include a storage means having a plurality of recorded audio samples stored thereon; a randomizing means and a sensing means wherein all said means are cooperatively connected together; upon activation of said sensing means, said randomizing means selects an audio sample from said storage means for said putting device to audibilize.

Other objectives, advantages, and novel features of the present invention will become more apparent from the following detailed description when taken in conjunction with the accompanying drawings.

BRIEF DESCRIPTION OF THE DRAWINGS

The following drawings, in which like reference characters indicate like parts, are provided for illustration of the invention and are not intended to limit the invention in any manner whatsoever.

FIG. I depicts a schematic view of the preferred embodiment operatively connected to a power source and an audio means.

DETAILED DESCRIPTION OF THE INVENTION

The following descriptions of the preferred embodiments are presented to illustrate the present invention and are not to be construed to limit the claims in any manner whatsoever. In reference to the drawings FIGS. I through 3B, the preferred embodiment of the present invention is disclosed, which is directed to a putting device I, which includes a sensing circuit 2A, a randomizing circuit 2B, a gain circuit 2C, and an amplification circuit 2D.

More specifically, the putting device I includes a storage means U3 having a plurality of recorded audio samples stored thereon; a randomizing means U2, and a sensing means S2; wherein all said means (U3, U2, and S2 respectively) are cooperatively connected together. Upon activation of said sensing means S2, said randomizing means U2 selects an audio sample from said storage means U3 for said putting device I to audibilize via an audio output AI.

Figure 1:
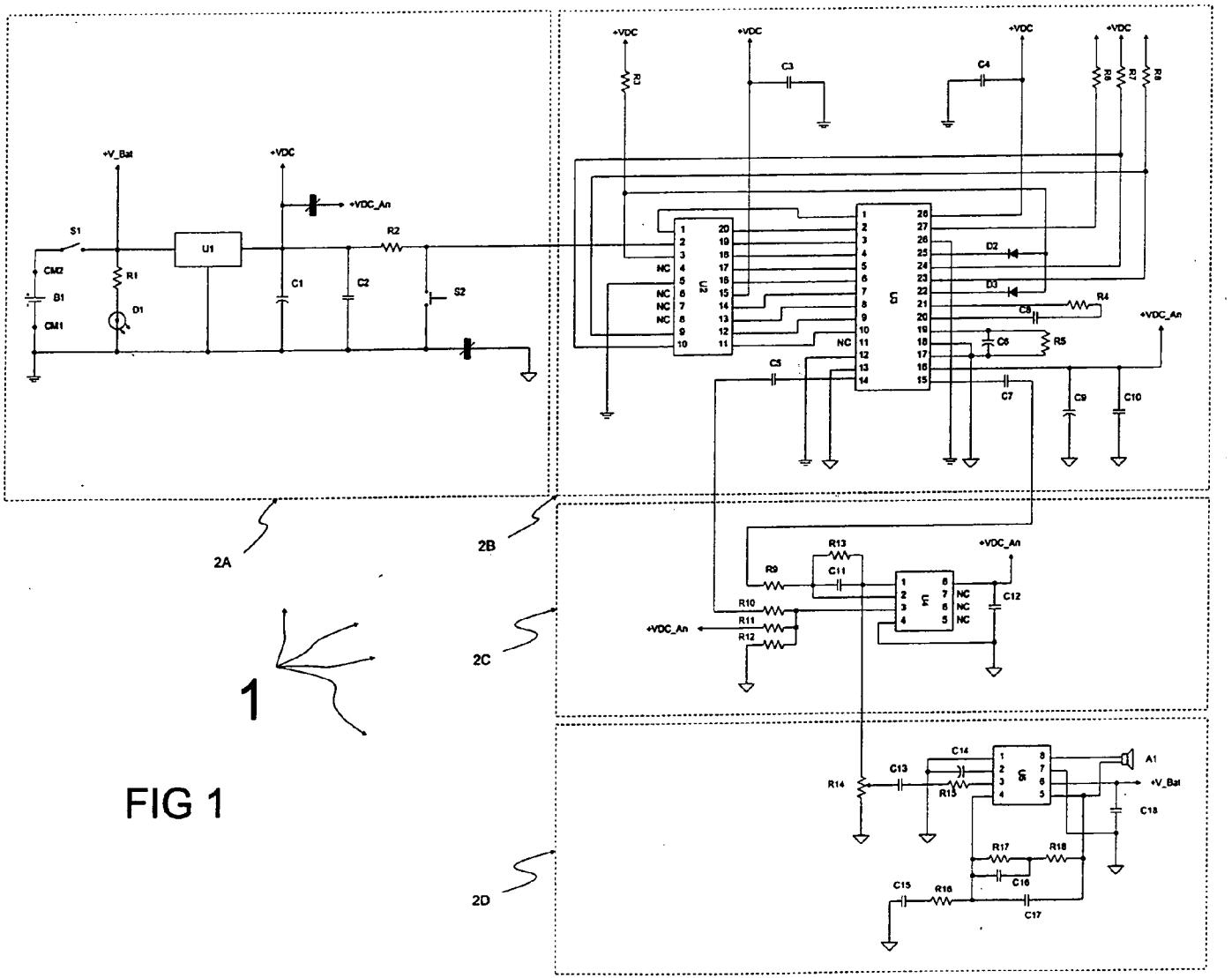
Figure 2A:
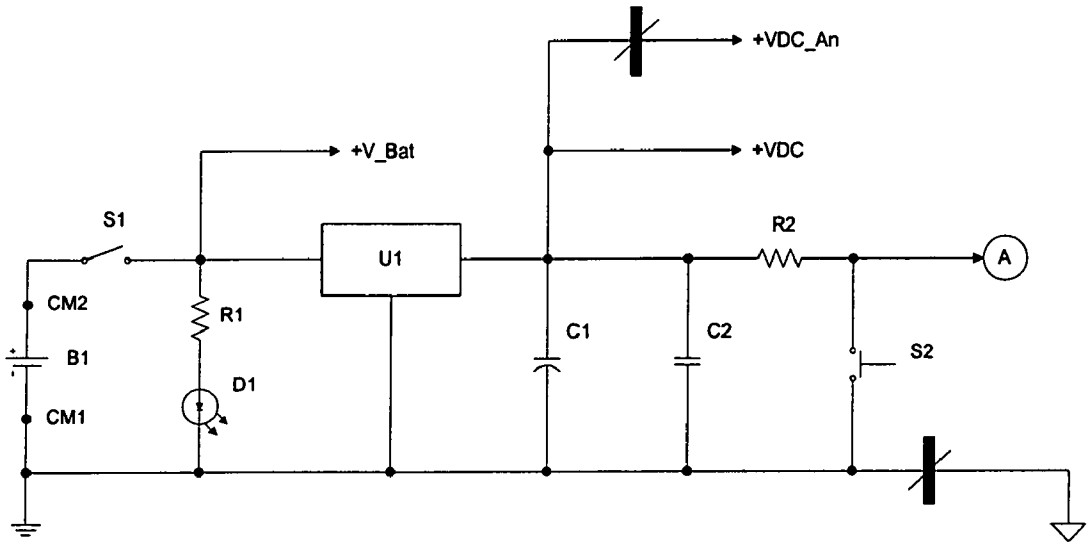
FIG. 2A depicts the circuitry of the sensing means of the preferred embodiment.
Figure 2B:
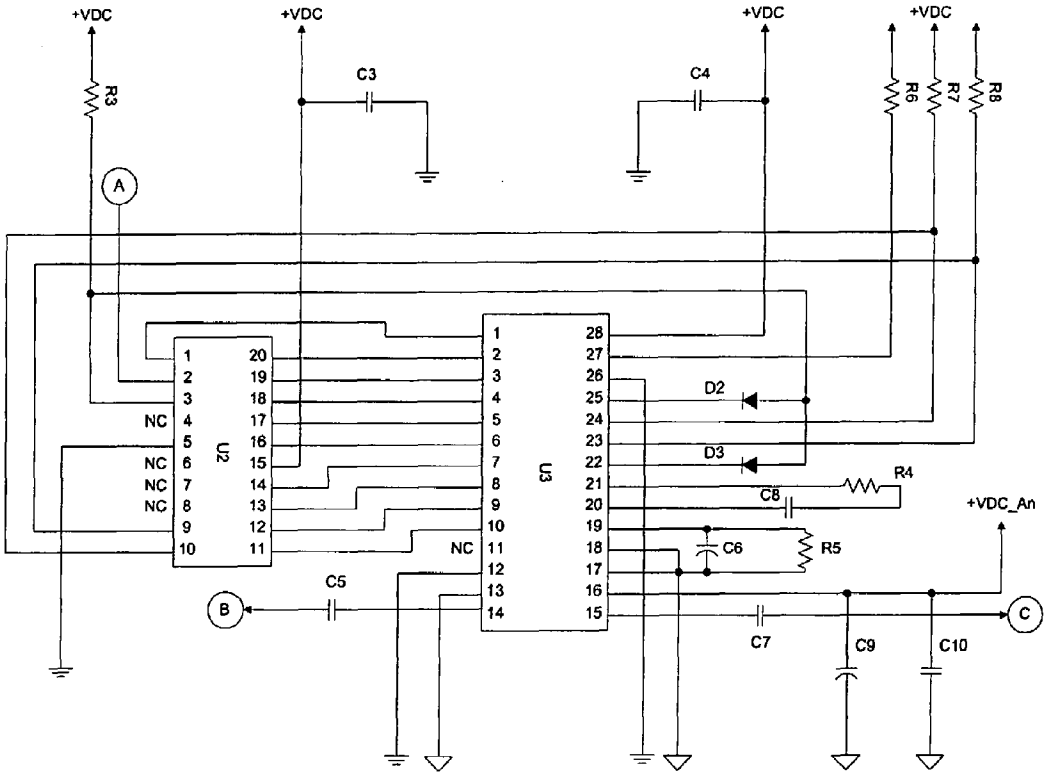
FIG. 2B depicts the electrical circuitry of the randomizing means and selection of audible samples of the preferred embodiment.
Figure 2C:
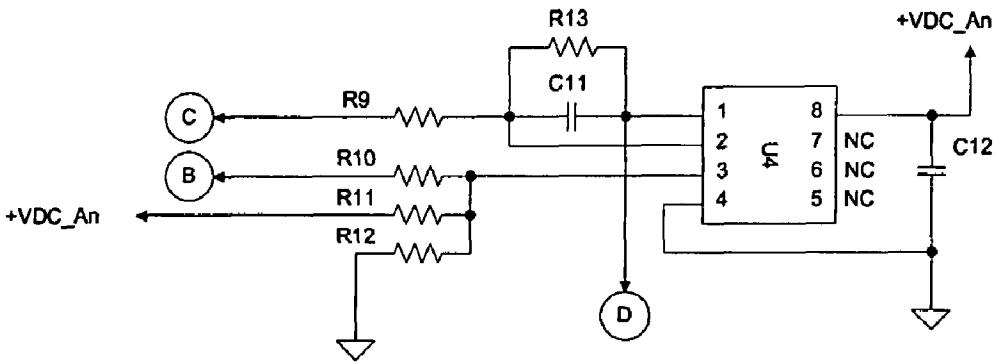
FIG. 2C depicts electrical circuitry of the gain, amplification, and output of the preferred embodiment.
Figure 2D:
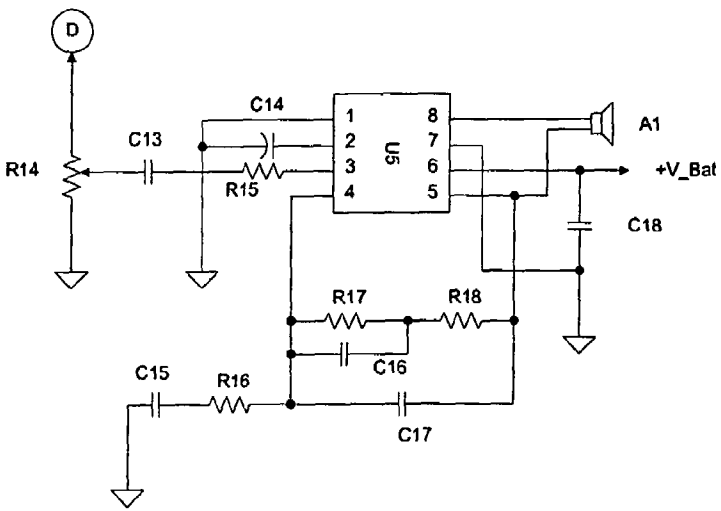
FIG. 2D depicts the amplification circuit.
Figure 3A:
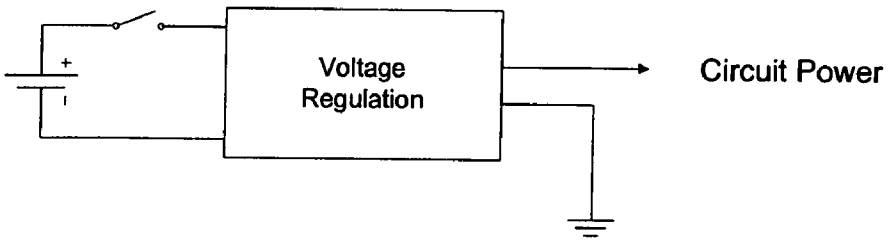
FIG. 3A depicts a block diagram of the electrical power circuitry of the preferred embodiment.
Figure 3B:
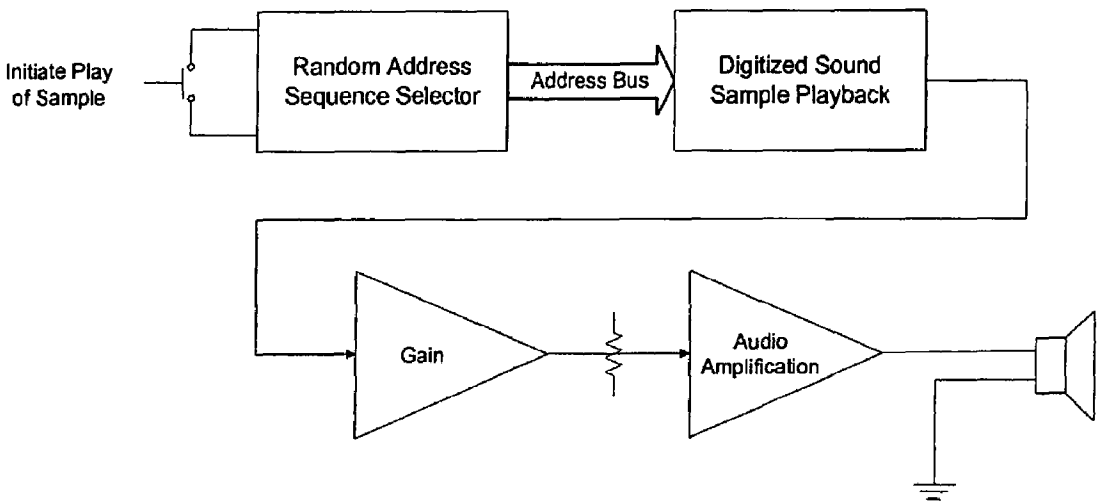
FIG. 3B depicts a block diagram of the electrical circuitry of the preferred embodiment.

In order to assist one in the understanding of the operation of the present invention 1,it would be advantageous to consider use in practice. In the preferred embodiment, power is supplied via a nine (9) volt battery B1, via connecting means CM1 and CM2 . In order to assist the user in determining whether there is sufficient power to utilize the putting device 1 once the switch S1 is closed, an LED D1 is connected thereto. As shown in FIG. 2A, the sensing means S2 is a momentary switch, which is activated by depression thereof. Once said means S2 is depressed, the randomizing means U2, here a microcontroller (e.g., 87LPC764manufactured by Philips, other manufacturers include, inter alia, Amtel, Cyprus, Hitachi, Intel Microchip, and Motorola.), selects a prerecorded audio sample from a storage means U3, here a microchip (e.g. 2575P manufactured by Information Storage Devices, Inc. now acquired by Winbond). The prerecorded audio samples are selected from the group of expressions consisting of "Did you see that", "Get in the hole!", "It's good!", "Oh, what a spectacular shot", "The crowd goes wild!", "Unbelievable!", "What a shot!", "Yes, it counts!", and "Yikes!"

The selected sample is thereafter sent through a gain circuit 2C and amplification circuit 2D prior to audibilization via a speaker AI. In particular, the gain circuit 2C includes an op-amp U4 (e.g., an op-amp BAI0358 manufactured by Rohm); whereas the amplification circuit 2D, includes an audio amplifier U5 (e.g., MC34II9P manufactured by Motorola) operatively connected thereto.

In alternative embodiments (not shown), the activation of said sensing means S2 is selected from the group consisting of a motion detector (e.g., mercury switch), photo-infrared (aka PIR), and/or physical contact with a golf ball. For example, when a player positions oneself adjacent to, but not directly over the ball, and begins to take a practice swing, the sensing means would detect the player's movement thereby initializing the chain of events ultimately yielding in an audibilization of at least one prerecorded audio sample. Moreover, it is envisioned that other forms of sensing devices may be substituted there for.

In another alternative embodiment (also not shown), the putting device includes a sleep feature, when said device is not activated within a predetermined time period; said feature is automatically activated to save power. This is particularly preferred when the power source is a battery.

In still another alternative embodiment (also not shown), the putting device includes a plurality of modes, wherein a mode may be selected from the group consisting of a coach, a comic, a rock-n-roll, and a spectator.

Examples, of the coach mode include comments such as, "Envision the line", "Focus", "Keep your head down", "Relax", "Take your time", etc.

Furthermore, for example, the comic mode includes comments such as, "Rookie!", "Beginner!", wherein a comment is audibilized when a player sinks his putt. This embodiment may also include comments which heckle and/or harass the player prior to sinking the putt. For example, when the player is setting up his shot, upon motion of the club and or motion of the player's body, a comment such as "Hey You!", "Jinx!", or "Loser!" may be played to distract the golfer. Moreover, any of these comments may be played randomly without motion detection. For example, a statement may be randomly played so as to entice an individual to become a player. After a predetermined period of inactivity of the game, the game may be reset/revert to the sleep mode.

For example, the rock-n-roll mode includes audibilization such as, "Augusta, Sweet Augusta", "Big Stick!", "Fire in the hole!", "It's about time!", "Par-Aid", or "Whoop, there it is!", wherein a song and/or comment is audibilized upon the player sinking his putt.

For example, the spectator mode includes comments such as, "I knew he'd make it", and "Yes!".

In still another embodiment of the present invention, additional modes include a business executive mode, and a child mode. In regards to the business executive mode, an array of audio samples may be recorded on the storage means that include positive reinforcement, political statements etc. For example, "Make this shot and you'll keep you job!", "You're so good". In regards to the child modes, an array of samples may be recorded that include instructional pointers. For example, "Use two hands", "Keep your eye on the ball", "Aim for the hole".

All of the above referenced patents; patent applications and publications are hereby incorporated by reference. Many variations of the present invention will suggest themselves to those of ordinary skill in the art in light of the above detailed description. All such obvious modifications are within the full-intended spirit and scope of the claims of the present application.

What is claimed is:

1. A putting device comprising:

a. a connecting means for electrically connecting said device to a power source;

b. a storage means having a plurality of recorded audio samples stored thereon;

c. a randomizing means and a sensing means cooperatively interconnected into a circuit and housed; upon activation of said sensing means, said randomizing means selects a sample to audibilize; wherein said device further comprises alternative modes of operation, wherein selection of each mode is manual; wherein said device is housed in the putter, a target, or combination thereof wherein said modes include a first mode selected from the group consisting of a commentator, a comedian, a rock-n-roll, and a spectator mode.

2. A putting device as in claim 1, wherein said housing provides mounts for said storage means.

3. A putting device as in claim 1, wherein said housing provides mounts for an audio speaker.

4. A putting device as in claim 1, wherein said housing provides mounts for said randomizing means.

5. A putting device as in claim 1, wherein said housing provides mounts for said sensor means.

6. A putting device as in claim 1 further having a sleep feature, when said device is not activated within a predetermined time period, said feature is automatically activated to save power.

7. A putting device as in claim 1, wherein said modes further include a second mode selected from the group consisting of a business executive, and a child.

8. A putting device as in claim 7, wherein said business executive mode includes audio samples selected from the group of expressions consisting of "Make this shot and you'll keep you job!", and "You're so good!".

9. A putting device as in claim 7, wherein said child mode includes audio samples selected from the group of expressions consisting of "Use two hands", "Keep your eye on the ball", and "Aim for the hole".

10. A putting device as in claim 1, wherein said device further includes a volume control.

* * * * *